US005345974A

United States Patent [19]

Bernardi et al.

[11] Patent Number: 5,345,974

[45] Date of Patent: Sep. 13, 1994

[54] HEALD SUPPORTING FRAME

[75] Inventors: Luigi Bernardi, Gandino; Antonio Bernini, Forano al Serio, both of Italy

[73] Assignee: Lamiflex S.p.A., Ponte Nossa, Italy

[21] Appl. No.: 941,284

[22] Filed: Sep. 4, 1992

[30] Foreign Application Priority Data

Sep. 11, 1991 [IT] Italy ..... MI91 A 002404

[51] Int. Cl.[5] ..... D03C 9/06

[52] U.S. Cl. ..... 139/91

[58] Field of Search ..... 139/91, 92

[56] References Cited

U.S. PATENT DOCUMENTS

| | | | |
|---|---|---|---|
| 4,307,757 | 12/1981 | Shimizu | 139/91 |
| 4,484,604 | 11/1984 | Kramer et al. . | |
| 4,750,526 | 6/1988 | Faasse et al. | 139/91 |
| 4,777,987 | 10/1988 | Asagi et al. | 139/91 |
| 4,790,357 | 12/1988 | Kramer | 139/91 |
| 4,913,194 | 4/1990 | Kramer . | |
| 5,004,019 | 4/1991 | Blontrock | 139/91 |

FOREIGN PATENT DOCUMENTS

| | | | |
|---|---|---|---|
| 0295189 | 12/1988 | European Pat. Off. . | |
| 0314181 | 5/1989 | European Pat. Off. . | |
| 457210 | 11/1991 | European Pat. Off. | 139/91 |
| 2610311 | 9/1977 | Fed. Rep. of Germany | 139/92 |
| 2607155 | 5/1988 | France . | |
| 345620 | 5/1960 | Switzerland . | |
| 925562 | 5/1963 | United Kingdom | 139/91 |
| 1103808 | 2/1968 | United Kingdom . | |

*Primary Examiner*—Andrew M. Falik

*Attorney, Agent, or Firm*—Guido Modiano; Albert Josif; Daniel O'Byrne

[57] ABSTRACT

A heald supporting frame constituted by a pair of horizontal cross-members for supporting the healds which are mutually rigidly locked by removable side members. The cross-members of the frame are formed by box-like structures made of composite material, in the ends of which inserts with high mechanical strength, made of metallic or composite material, are embedded so as to couple them, and the side members, as well as bushes for connecting the frame to the loom, are mechanically fixed to the inserts.

4 Claims, 3 Drawing Sheets

HEALD SUPPORTING FRAME

BACKGROUND OF THE INVENTION

The present invention relates to a heald supporting frame with composite structure for weaving looms.

As is known, heald supporting frames are used in weaving looms to support a plurality of healds, or heddles, each of which has a warp thread associated therewith. Said frames are constituted by rectangular structures which have a modest thickness, are as long as the maximum, width of fabric which can be processed on the loom for which they are intended, and are formed by two parallel cross-members, respectively an upper one and a lower one, to which the healds are coupled, and by a pair of side members which have the purpose of rigidly connecting the cross-members and must be easily removable in order to allow the insertion of the healds. The heald supporting frames are furthermore connected to a movement system which can move them vertically in order to achieve coordinated movements of the sets of warp threads connected to each frame, opening the pitch for the insertion of the weft according to the particular pattern to be provided in the fabric.

According to the known art, both the healds and the frames which support them are made of metallic materials in order to ensure adequate rigidity and solidity of the assembly. Since these are mechanical elements which perform a rapid or very rapid reciprocating motion, the current trend is naturally to make these elements using aluminum or light alloys in order to minimize their mass and thus their inertia. In order to maintain the necessary rigidity of the frame, this minimization cannot, in any case, exceed a certain limit, unless one uses special metallic alloys with low specific gravity and high mechanical strength, which however would increase the cost of the frame to excessively high levels.

A typical problem of known metallic heald supporting frames is noise. In fact, since the healds are coupled to the frame with a certain play, multiple mutual impacts between the frame and the healds occur during the movement of the frame, with metal-on-metal contacts which cause very high noise.

It has therefore been proposed to manufacture heald supporting frames made of different materials, particularly synthetic ones, but these proposals have not been able to achieve the intended aims of lightness and low cost at the same time.

SUMMARY OF THE INVENTION

The aim of the present invention is indeed to provide a heald supporting frame wherein the presence of metallic materials is drastically reduced and which, by achieving rigidity parameters which are comparable with those of full-metal frames, achieves better results than said metal frames in terms of lightness and noise.

An object of the invention is to provide a device for the self-centering fixing of the side members of the heald supporting frame which allows to disassemble and reassemble the side members, in order to insert the healds, in a very easy manner, obtaining, at the same time and automatically, the perfect parallel arrangement of the two cross-members.

This aim and this object are achieved, according to the present invention, by means of a heald supporting frame of the type which is constituted by a pair of horizontal cross-members for supporting the healds which are mutually rigidly locked by removable side members, characterized in that said cross-members are formed by box-like structures of composite material in whose ends inserts with high mechanical strength are included, so as to couple them perfectly, and in that said side members, as well as the means for connecting the frame to the loom, are fixed to said inserts.

BRIEF DESCRIPTION OF THE DRAWINGS

The frame is in any case now described in detail with reference to a preferred embodiment thereof, wherein:

FIG. 6 is a sectional view of a side member in a first different embodiment;

FIG. 7 is an enlarged-scale view of a detail of an end of a side member coupled to the upper cross-member; and FIG. 8 is a sectional view of the same detail as FIG. 7.

DESCRIPTION OF THE PREFERRED EMBODIMENTS

Figure 1:
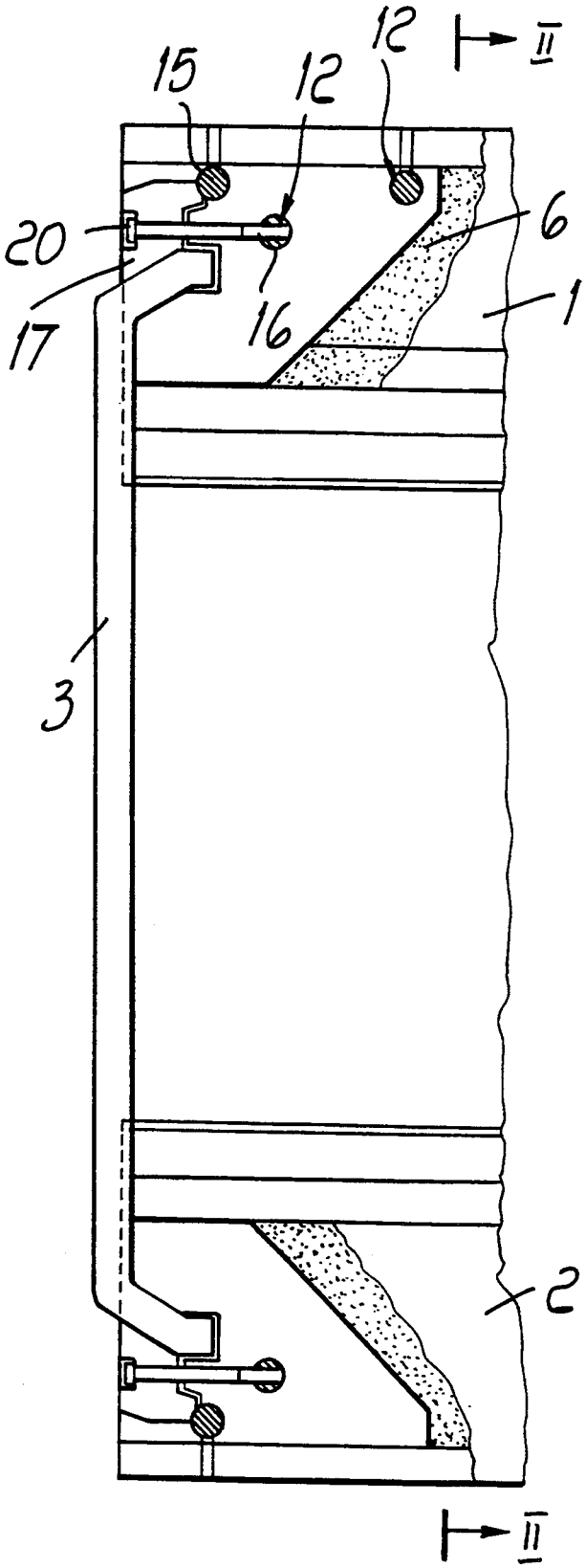
FIG. 1 is a front view of the lateral end portion of a heald supporting frame according to the present invention.

As described in the introductory section, a heald supporting frame is generally formed by an upper cross-member 1 and by a lower cross-member 2 which are laterally joined, at their ends, by side members 3 which mutually lock them in a perfectly parallel position, so as to allow the support of a plurality of healds 4 which are coupled, at their opposite ends 4*s* and 4*i*, to adapted ridges defined on the cross-members 1 and 2.

Figure 2:
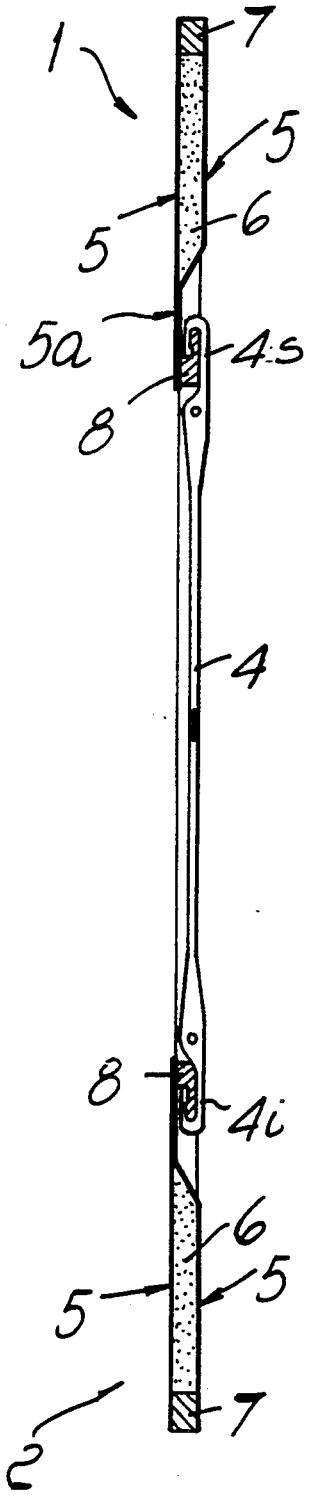
FIG. 2 is a sectional view of said frame, taken along the plane II—II of FIG. 1.
Figure 3:
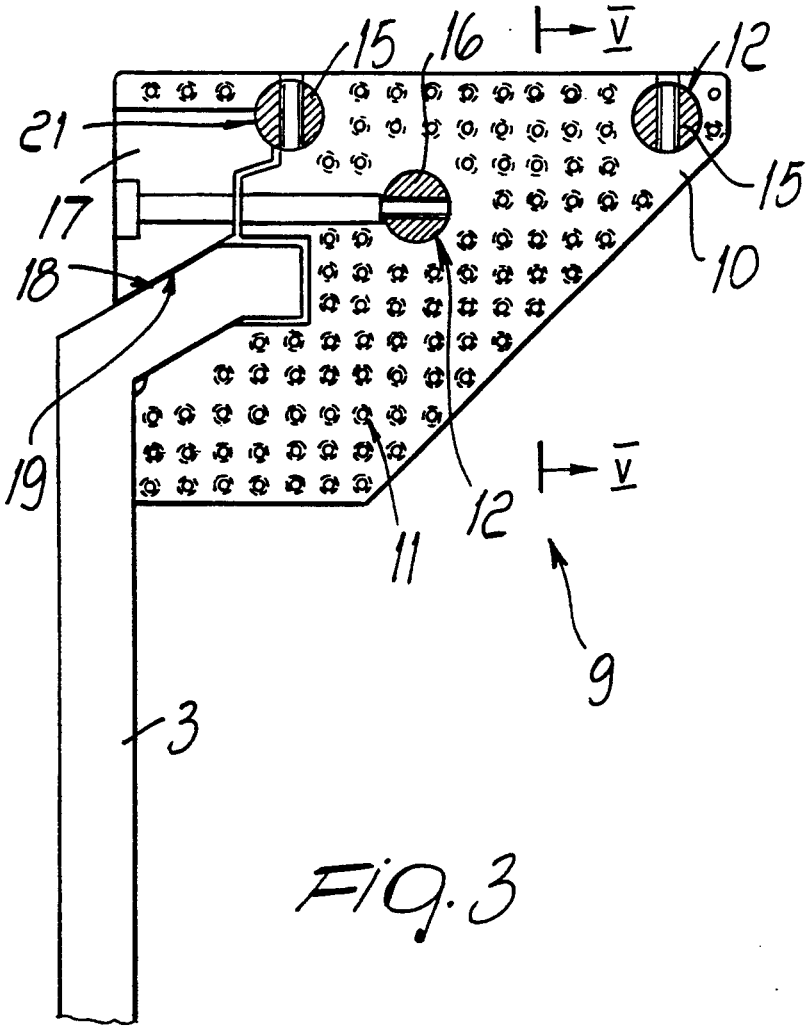
FIG. 3 is an enlarged-scale front detail view of the terminal insert of the cross-members and of the device for the self-centering fixing of the side members.
Figure 4:
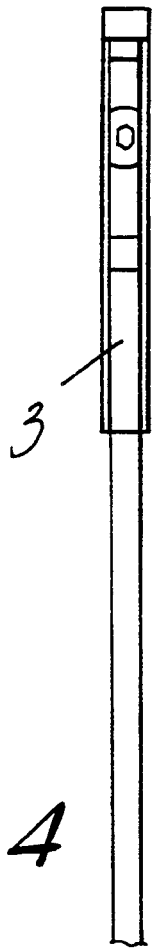
FIG. 4 is a side view of the same detail as FIG. 3.

According to the present invention, the cross-members 1 and 2 are mutually similar and are formed—as clearly shown in cross-section in FIG. 2—by a box-like structure which comprises outer walls 5 and a filler material 6. The box-like structure is closed on one side—the one directed toward the healds—simply by folding one of the two walls until it overlaps the other one; on the opposite side, said structure is instead closed by a rectangular section element 7 which is embedded in the walls 5 during their forming, thus contributing to the stiffening of the frame.

In the region where the two walls 5 overlap so as to close the box-like structure of the cross-members 1 and 2, said walls extend further with a wing 5*a* to which an L-shaped, angle element 8 is fixed, preferably by glueing. Said angle element 8 thus constitutes the ridge for the engagement of the healds 4, as clearly shown in FIG. 2.

The outer walls 5 of the cross-members 1 and 2, as well as the elements 7 and 8, are constituted by composite materials; this term designates, in the present description, materials formed by fibers or fabrics of various kinds, impregnated with synthetic resin and shaped as required with an appropriate molding and pultrusion process. As examples of fibers and fabrics suitable for this purpose, mention can be made of fibers and fabrics obtained from glass, cotton, carbon, Kevlar etc. As examples of suitable synthetic resins for impregnation, mention can be made of epoxy, phenolic and thermoplastic resins. In addition, the angle element 8 can be provided with an appropriate wear-resistant metallic protection in order to increase its resistance to the large number of impacts received from the hook-like ends 4*s* and 4*i* of the healds 4 during the movement of the frame. The filler material 6 of the box-like structure is instead constituted by a foamed plastic material, for example a foamed polyurethane resin, which combines very low specific gravity with high sound-deadening power which helps to attenuate the noise of the frame.

Studies and practical tests conducted by the Applicant have shown that the above described box-like structure of the cross-members 1 and 2, despite being lighter than the corresponding known metallic structures, achieves perfect rigidity even in considerably wide frames and maintains its shape in time. However, this structure, indeed due to the structural flimsiness of the elements which compose it, while being perfectly suitable to support the distributed load constituted by the healds, would be unsuitable to support concentrated loads such as those which are typically due to the points for fixing the cross-members to the side members and to the means for connection to the loom.

These technical considerations have led to the solution proposed by the Applicant, which is described herein and according to which inserts 9 having high mechanical strength are embedded inside the box-like structure, and at its ends, which constitutes the cross-member 1 or 2 and are intimately linked to the walls 5 of said box-like structure. Said points where concentrated forces are applied—i.e. the points where the frame is suspended from the loom and the side members fixing points—are thus gathered on these inserts 9 so that the concentrated stresses can be distributed on the entire box-like structure without causing local yielding thereof which would compromise its rigidity and dimensional stability.

According to the present invention, the inserts 9 with high mechanical strength—which naturally must have the lowest possible weight and have a modest cost—have a sandwich-like structure constituted by a pair of plates 10 made of metallic or composite material between which a thermoplastic-resin filler is interposed. Each plate 10 has the general shape of a right-angled trapezoid and has, on one of its right-angled sides and specifically on the one directed toward the side member 3, a recess which has an irregular shape and in which the end of the side member 3 and the related fixing device are accommodated, as will become apparent hereinafter. The plates 10 furthermore have a plurality of small holes 11 distributed on their entire surface.

Figure 5:
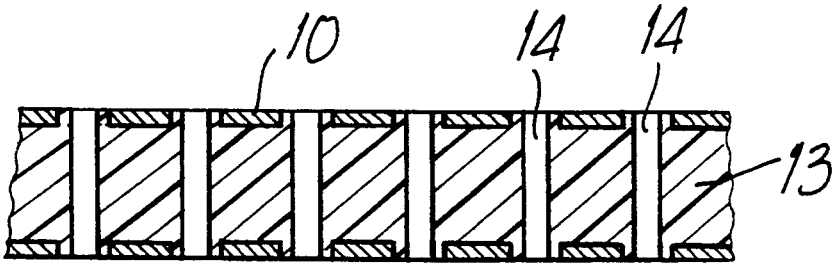
FIG. 5 is a sectional enlarged-scale view of the terminal insert of the cross-members, taken along the plane V—V of FIG. 3.

Prior to assembly inside the cross-members 1 and 2, each pair of plates 10 is, as mentioned, pre-assembled in a sandwich-like manner with the interposition of a thermoplastic resin 13 in an injection mold. The shape of the mold is identical to the shape of the plates 10, and said mold is furthermore provided with a plurality of pins which partially occupy the holes 11. In this manner, once molding has occurred, the sandwich foraged by the plates 10 and by the thermoplastic material 13 has the cross-section shown in FIG. 5, i.e. has a series of holes 14 the diameter of which is slightly smaller than the diameter of the holes 11, with an arrangement which thus allows to achieve safe and perfect grip of the thermoplastic resin 13 on the plates 10.

Once the plates have thus been pre-formed in a sandwich-like manner with the injection of thermoplastic material, constituting the insert 9 with high mechanical strength, said insert is embedded in the box-like structure which constitutes the cross-members 1 and 2 at their ends, so that the side provided with the recess for accommodating the side member 3 is located toward the outside of the cross-member, as clearly shown in FIG. 1. The insert 9 is inserted in the cross-member in the same position occupied, in the remaining part of the cross-member, by the foamed material 6, before said cross-member is finally formed by impregnating the walls 5 with synthetic resins.

In other words, the various parts which constitute the cross-member 1 or 2, i.e. the foamed material 6, the inserts 9, the element 7 and the fabric which will form the walls 5, are arranged in their final position inside a mold and then the entire assembly is impregnated with a synthetic resin which is then polymerized, foxing the cross-member as a monolithic unit. In fact, the synthetic resin, in addition to impregnating the fabric in order to form the walls 5, also fills all the holes 14 of the inserts 9, thus providing a perfect and very solid anchoring between the insert 9 and the overlying walls 5. The two cross-members 1 and 2 thus formed are completed by glueing the angle elements 8 and by drilling seats 12 in which respective bushes 15 and 16, provided with an internal female thread, are accommodated; the cross-members are connected to the loom by means of said bushes and are mutually rigidly coupled by means of the side members 3.

Said side members, again in order to ensure maximum rigidity and at the same time maximum lightness of the heald supporting frame, are constituted by metallic structural elements or preferably by a solid structural element made of composite material. In order to mutually couple the side members 3 and the cross-members 1 and 2, avoiding the drilling of holes on the side members 3, whose structure would thus be weakened by them, the Applicant has provided a particular fixing device which, in addition to ensuring rigid and perfect locking between the parts, at the same time achieves the purpose of reproducing, in a perfectly constant and calibrated manner, the fixing conditions and in particular the parallel arrangement of the cross-members 1 and 2 after each disassembly and reassembly without having to perform specific checks or adjustments.

Said device is essentially constituted by a metallic wedge 17 which is inserted in the recess of the insert 9 and mates therewith; an inclined flat surface 18 of said wedge cooperates with an identical surface of the terminal part of the side member 3. The wedge 17 is fixed in position by tightening an Allen screw 20 which passes through said wedge and engages in the female thread of the bush 16. The wedge 17 furthermore has, in its upper part, a concave curved surface 21 which cooperates with the convex outer surface of one of the bushes 15, which for this purpose partially protrudes inside the recess of the insert 9. By tightening the screw 20, the surface 21 rotates on the bush 15, and the surface 18 of the wedge pushes the surface 19 of the side member 3 until the inner walls thereof rest against the corresponding walls of the insert 9, fixing the side member in a single possible position which is indeed the one preset during design.

The side members 3 are fixed only after the healds 7 have been coupled to the angle elements 8, and after this operation the frame is ready for use. The bushes 15 are used to couple the frame to the suspension means provided on the loom, after appropriately providing holes in the element 7 at said bushes, as clearly shown in FIG. 1, using ordinary threaded screws which engage in said bushes.

Figure 6:
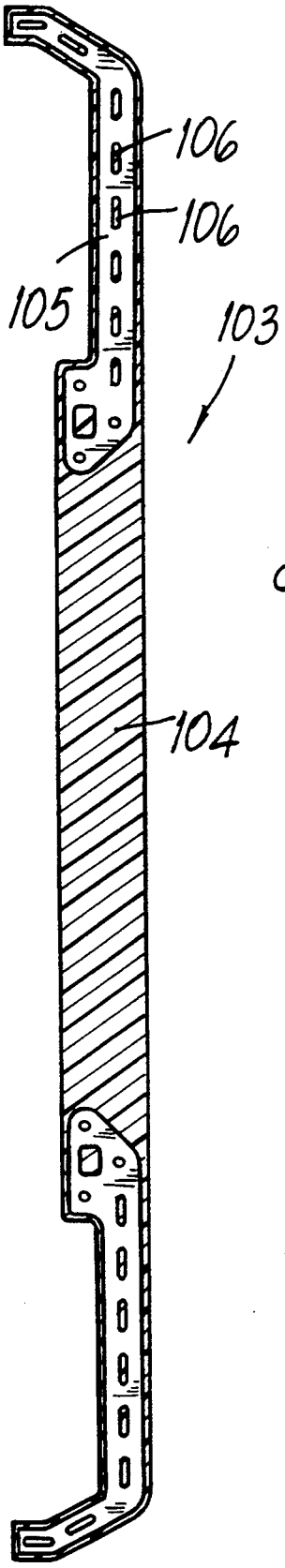
FIGS. 6 to 8 are views of two different embodiments of the side members, and more particularly.
Figure 7:
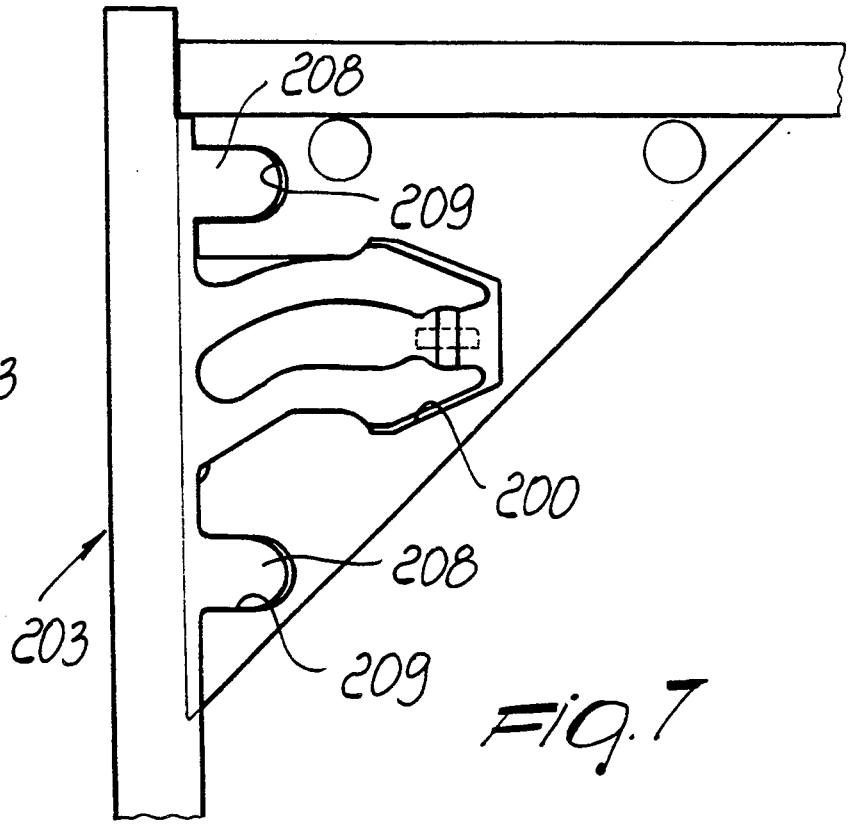
Figure 8:
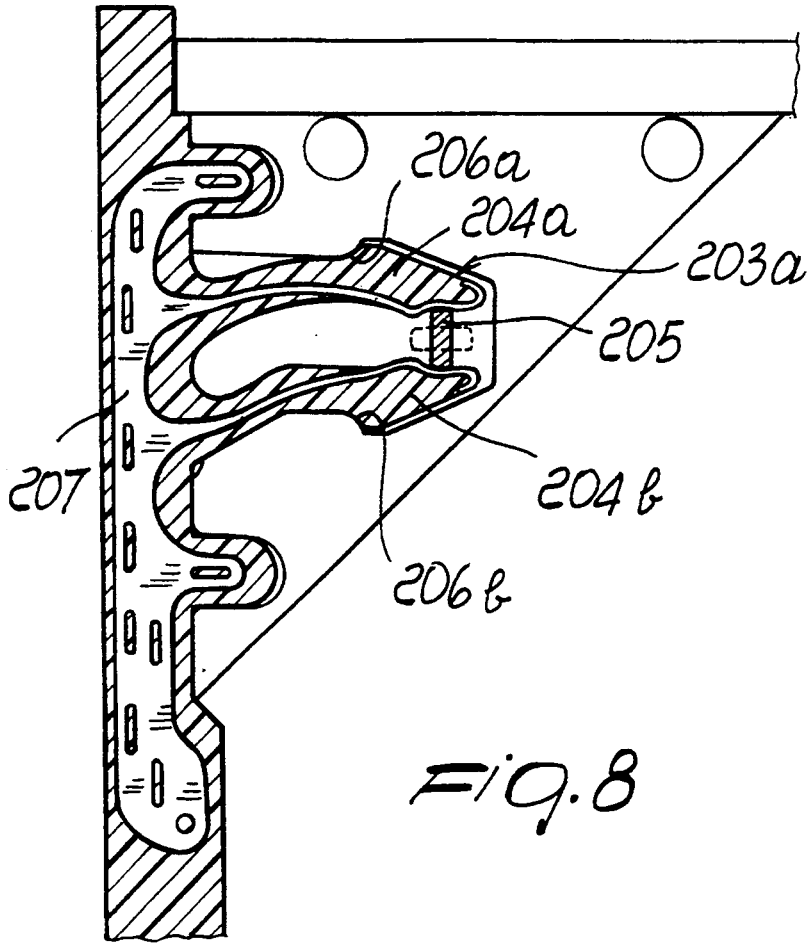

As shown in FIGS. 6 to 8, the side members can be made of plastic material with inserts having high mechanical strength at the ends thereof which are to be coupled to the cross-members.

More particularly, as illustrated in FIG. 6, the side members 103 can be provided by means of a body 104 made of molded thermoplastic synthetic material, for example nylon loaded with carbon fibers, in which steel plates 105 are embedded during molding at the ends of said body which are to be associated with the cross-members 1 and 2. Said plates 105 are conveniently crossed through by holes 106 for anchoring to the synthetic material which embeds them.

As shown in FIGS. 7 and 8, the ends of the side members can also be provided expandable, so that they are inserted in a recess 200 defined in the cross-members 1 and 2 and are then expanded in order to fix the side members to the cross-members.

In this case, too, the side members 203 are preferably made of plastic material with steel plates 207 embedded at their ends.

The ends 203*a* of the side members are provided with a pair of lateral arms 204*a* and 204*b* which are elastically flexible toward and away from one another, and a spacer element 205 is provided; said spacer element can be inserted between the arms 204*a* and 204*b* after they have been inserted in the recess 200 in order to cause their mutual spacing, which provides their engagement against shoulders 206*a* and 206*b*, defined on the sides of the recess 200, which cause the locking of the arms 204*a* and 204*b* in the recess 200.

The ends 203*a* of the side members may also be provided with one or more centering pins 208 to be inserted in seats 209 defined in the cross-members 1 and 2.

From the above description it is evident that the heald supporting frame according to the present invention has fully achieved the intended aim and object. It has a structure made of very light and strong composite materials, and the presence of the heavier metallic materials is reduced to a minimum. This structure allows to achieve exceptional lightness of the frame and, at the same time, great rigidity thereof, making said frame fully suitable to be used on high-speed looms. The functionality of the frame is furthermore completed by the particular side member fixing device and by the extremely small dimensions of said side members, and these facts make the heald replacement operation extremely easy and rapid.

We claim:

1. Heald supporting frame comprising:

a pair of horizontal heald supporting cross-members, said cross members comprising box-like structures, said box-like structures being made of composite material and having ends;

inserts of high mechanical strength connected to said ends of said box-like structures;

a pair of removable side members, said side members having side member ends and being fixed to said inserts for coupling and rigidly locking together said supporting cross members, and;

means for connecting said heald supporting frame to a loom fixed to said inserts;

wherein said inserts are inserted within said ends of said box-like structures, said box-like structures each having walls, an interspace defined between said walls, and an interspace width defined by said interspace, said inserts defining an insert thickness, said insert thickness being equal to said interspace width, and;

wherein said inserts are constituted by a sandwich-like structure comprising a pair of plates made of metallic or composite materials, and a layer of thermoplastic resin interposed between said plate, said layer of thermoplastic resin having through holes formed therein, said metallic plates having corresponding holes formed therein, said through holes having a smaller diameter than said corresponding holes formed in said plates, said corresponding holes formed in said plates being thus partially covered by a ring of thermoplastic material.

2. Heald supporting frame according to claim 1, further comprising:

seats formed in said inserts, and;

self-centering fixing means for removably coupling said side member ends in said seats formed in said inserts;

wherein said self-centering means comprise;

a wedge pivotally connected to said insert;

screw means for adjustably fixing said wedge to said insert;

an inclined surface defined by each of said side members;

an inclined flat surface defined by said wedge, said inclined flat surface being oblique with respect to said screw means for adjustably fixing said wedge to said insert;

an inclined surface defined by each of said side members;

an inclined flat surface defined by said wedge, said inclined flat surface being oblique with respect to said screw means and cooperating with said inclined surface of one said side members;

wherein to push said one of said side members into one of said seats for coupling with said insert, and locking said side member in said seat.

3. Heald supporting frame according to claim 2, further comprising;

at least one threaded bush accommodated in said insert for fixing said heald supporting frame to a loom;

an outer convex surface defined by said threaded bush, and;

concave surface defined by said wedge and cooperating with said outer convex surface of said threaded bush;

whereby to permit pivotal movement of said wedge about said outer convex surface of said threaded bush.

4. Heald supporting frame according to claim 1, further comprising:

a recesses defined in said cross members;

sides defined by said recesses;

a pair of lateral arms connected to each of said side member ends, said lateral arms being elastically flexible towards or away from one another and being insertable in one of said recesses;

shoulders defined on said sides of said recesses, and;

a spacer element insertable between said arms to mutually space said arms, whereby to cause engagement of said arms against said shoulders defined on said sides of said recesses.

* * * * *